US007150707B2

(12) United States Patent
Taubenheim

(10) Patent No.: US 7,150,707 B2
(45) Date of Patent: Dec. 19, 2006

(54) FOLDING BOX GLUING MACHINE FOR PRODUCTION OF FOLDING BOXES FROM BLANKS

(75) Inventor: Gerd Taubenheim, Erkelenz (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 49 days.

(21) Appl. No.: 11/113,089

(22) Filed: Apr. 22, 2005

(65) Prior Publication Data

US 2005/0221969 A1 Oct. 6, 2005

(30) Foreign Application Priority Data

May 4, 2004 (DE) ..... 10 2004 022 211

(51) Int. Cl.
*B31B 1/04* (2006.01)

(52) U.S. Cl. ..... 493/71; 493/16; 493/55; 493/125; 493/179

(58) Field of Classification Search ..... 493/12, 493/16, 55, 71, 125, 126, 128, 179, 182, 493/472, 475, 476, 478; 193/35 R, 37; 198/817
See application file for complete search history.

(56) References Cited

U.S. PATENT DOCUMENTS

| | | | | |
|---|---|---|---|---|
| 4,585,432 | A * | 4/1986 | Marysse | 493/59 |
| 4,988,330 | A * | 1/1991 | Bensberg | 493/16 |
| 4,998,910 | A | 3/1991 | Mohaupt et al. | |
| 5,342,278 | A * | 8/1994 | Kurandt | 493/16 |
| 5,647,589 | A | 7/1997 | Kurandt | |
| 5,978,499 | A * | 11/1999 | Tossel et al. | 382/141 |
| 6,099,450 | A * | 8/2000 | Schenone et al. | 493/23 |
| 6,244,225 | B1 | 6/2001 | Takahashi et al. | |
| 6,323,502 | B1 * | 11/2001 | Battut | 250/559.19 |
| 6,811,526 | B1 | 11/2004 | Jansen | |
| 6,971,979 | B1 * | 12/2005 | Saro | 493/16 |
| 2004/0033875 | A1 | 2/2004 | Jansen | |

FOREIGN PATENT DOCUMENTS

| | | |
|---|---|---|
| DE | 36 09 148 A1 | 10/1986 |
| DE | 195 02 676 A1 | 7/1996 |
| DE | 199 44 017 A1 | 3/2000 |
| DE | 199 48 017 | 4/2001 |
| DE | 102 24 814 A1 | 12/2003 |
| EP | 1 020 392 | 7/2000 |

* cited by examiner

*Primary Examiner*—Hemant M. Desai
(74) *Attorney, Agent, or Firm*—Keating & Bennett, LLP

(57) ABSTRACT

A folding box gluing machine has a folding station in which portions of blanks provided with a glue strip are folded, and a subsequent transfer station which includes as a conveyor mechanism at least two pairs of conveying straps, each including an upper and a lower strap, and having a device for achieving the sideways removal of defective boxes arranged on the outside next to one pair of conveying straps. The upper conveying strap on at least one lengthwise side in the transfer station is supported in one region of its conveying path by support rollers, which are secured to a bearing plate, which is mounted with its lower edge tilted inward relative to a perpendicular plane and can move upward to a limited extent, and a guide baffle is secured on the inside next to the support rollers and extends upward from the inner edge of the upper conveying strap and is angled in the direction of the other pair of conveying straps.

20 Claims, 3 Drawing Sheets

FOLDING BOX GLUING MACHINE FOR PRODUCTION OF FOLDING BOXES FROM BLANKS

BACKGROUND OF THE INVENTION

1. Field of the Invention

The present invention is directed to a folding box gluing machine for the production of folding boxes from blanks in a folding station, in which portions of blanks provided with a glue strip are folded, and a subsequent transfer station, which includes as a conveyor mechanism at least two pairs of conveying straps, each having upper and lower straps, and including a device for achieving the sideways removal of defective boxes arranged on the outside adjacent to one of the pairs of conveying straps.

2. Description of the Related Art

As is known, folding box gluing machines include a transfer station behind the last folding station, in which portions of blanks provided with a glue strip are folded. This station feeds the folded boxes, oriented exactly in all of their portions, having glue seams that have not yet hardened, to a subsequent collecting and pressing mechanism. In the collecting and pressing mechanism, a stream of folded boxes is formed, which is then conveyed between pressing belts and maintained under pressure for a desired amount of time, until the glue seams have hardened.

It is known to provide an extracting device in the transfer station in order to remove boxes detected as being defective before the stream of boxes is formed at the collecting and pressing mechanism. The boxes are still delivered singularly and spaced apart from each other by the transfer station, such that an individual box can be removed from the machine. Defective boxes are boxes that are not sufficiently glued, boxes that contain folding errors, or boxes that are identified as not conforming to the job order.

The transfer station includes conveying elements defined by at least two pairs of conveying straps, each including upper and lower straps. An extracting device is defined by a mechanism that is arranged outside along a lateral pair of straps which engage a portion of the box projecting above the straps on the outside, in order to pull the defective box to one side through the pair of conveying straps.

Known devices for pulling the boxes out include turning plate ejectors, which include a turning plate that is driven at high rotary speed and that extends underneath the projecting portions of the box, and clamping elements that are arranged above the projecting portions of the box. When a box is defective, it is fastened against the turning plate by the clamping elements and pulled out from the machine by the rotation of the turning plate. Such a mechanism is described in DE 102 24 814 A1. Turning plate ejectors are secure in operation and require little structural expense. However, turning plate ejectors are only suitable for small to medium size boxes.

Larger boxes are extracted by so-called linear ejectors, as are described in DE 195 02 676 A1. Linear ejectors include two belt conveyors, between which the boxes are clamped and removed from the machine along a linear path. Linear ejectors are very expensive.

Extraction devices that pull the boxes out only on one side have the disadvantage that certain types of boxes do not lend themselves to being extracted. Thus, oversized boxes and boxes having uncovered lengthwise flaps folded inward on both sides cannot be extracted. If such boxes are pulled out to one side, the danger exists that the box will rip a conveying strap from its guide. The reason for this is that the inwardly folded, uncovered lengthwise flap on the far side will open as soon as it is pulled out between the first pair of conveying straps and hit the second pair of conveying straps in the opened state, catching the upper strap. Such nonextractable folding boxes include, for example, four-point boxes.

In order to be able to extract such boxes and oversized boxes, it is known from DE 199 48 017 A1 how to arrange a knife cutter in the conveying direction at the beginning of the transfer station and an extraction device at each lengthwise side of the transfer station. The knife cuts through the boxes in the middle prior to the extraction point, such that one half of the box can be pulled out on either side without difficulty. This type of extraction device is also very expensive. In addition to the lengthwise knife, this extraction device also requires an ejector on each lengthwise side of the transfer station.

Therefore, the problem underlying the present invention is to configure a folding box gluing machine such that even boxes with uncovered lengthwise flaps folded inward on both sides, especially four-point boxes, can be extracted as a single piece to one side.

SUMMARY OF THE INVENTION

To overcome the problems described above, preferred embodiments of the present invention provide an upper conveying strap on at least one lengthwise side of the transfer station that is supported along one conveying region by support rollers which are secured to a bearing plate. The bearing plate is mounted such that its lower edge is tilted inward relative to a perpendicular plane and can move upward to a limited extent, and a guide baffle is secured on the inside next to the support rollers and extends upward from the edge of the upper conveying strap and is angled inwardly.

Because of the tilt, a small V-shaped opening is provided between the upper and lower straps on the inner side, to which the folding flaps that have a tendency to open are fed, being forced down by the guide baffle. The upper conveying strap can move upward to a limited extent, such that upward pressing portions of the box push the upper conveying strap upward, and thereby force their way out between the two conveying straps. The transport of the boxes not being extracted is not affected by the slight tilt angle of the upper conveying strap. Thus, the device does not have to be removed when not in use.

In addition, the installation of the mechanism causes no format restrictions with respect to the boxes being processed and the mechanism can be selectively mounted at either of the two lengthwise sides.

The mechanism preferably includes an adjustable tilt angle of the bearing plate which provides an adjustment to different types and formats of boxes.

The conveying strap is preferably supported by two groups of support rollers, such that the upper conveying strap is strengthened and protected against a sideways displacement. The two groups of support rollers are preferably spherical rollers.

Preferably, the guide baffle on the bearing plate is vertically adjustable, which makes it possible to position the guide baffle such that no abutting edge, which could prevent the boxes from being pulled out, is provided for the upper conveying strap.

The mechanism preferably further includes supporting rods, which prevent the boxes from slipping down while being pulled out to the side.

The extraction elements may be provided on both lengthwise sides to enable an optional extraction on both sides.

Other features, elements, steps, characteristics and advantages of the present invention will become more apparent from the following detailed description of preferred embodiments with reference to the attached drawings.

DETAILED DESCRIPTION OF PREFERRED EMBODIMENTS

Figure 1:
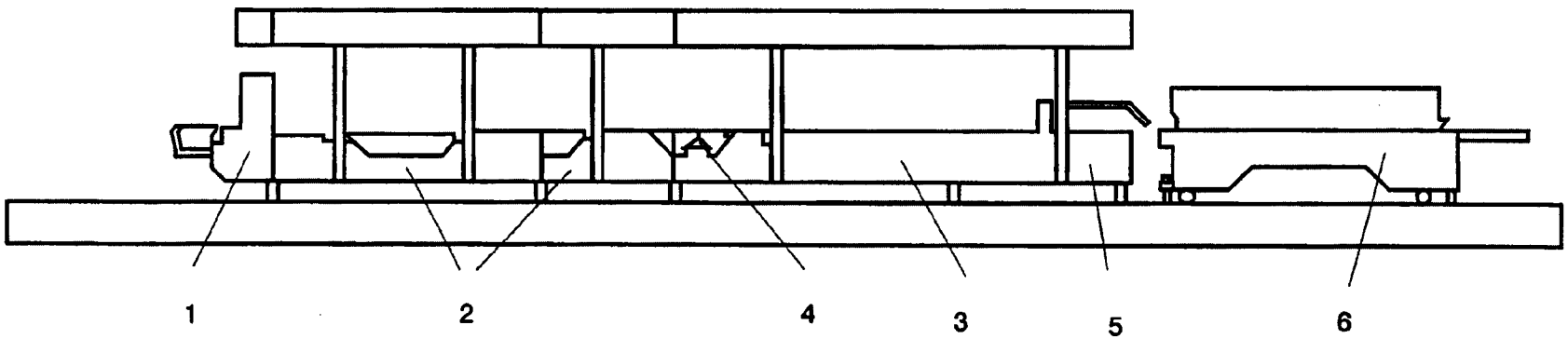
FIG. 1 shows a schematic side view of individual stations of a folding box gluing machine.

In the delivery direction (from left to right), the folding box gluing machine begins with an inserter 1, which pulls blanks one after the other from a stack at high speed and introduces the blanks individually to the following processing stations. A primary breaker 2 is disposed after the inserter 1, which includes two stages in the present preferred embodiment. The breaker 2 includes folding elements, in order to fold flaps forward and backward, so as to produce the corresponding lengthwise grooves that are soft and flexible.

After the primary breaker 2, a folding station 3 is provided, which includes an applicator 4 for adhesive, such as glue, that is disposed at the beginning thereof. The adhesive applicator 4 preferably includes glue nozzles or glue disks, from which the glue is applied in a strip on the blanks. Before the folding flaps provided with glue strips are folded by folding elements of the folding station 3, a check is performed of the applied glue strip. For this, the glue strip is scanned in a non-contact manner with a glue charge checking device. If the quality of the glue strip is not satisfactory, the box is reported to the central control unit as being defective. At the end of the folding station 3, the folded boxes are checked for folding errors. For this, photocells are arranged in this region, with which the length of the box is determined. If the length does not correspond to the desired format, e.g., because a flap was not properly folded, this box is also reported to the central control unit as being defective.

Immediately following to the folding station 3 is a transfer station 5, primarily for feeding the folded boxes, provided with seams of not-yet-hardened glue and oriented in all of their parts, to the following collecting and pressing mechanism 6. A stream of the folded boxes 7 is produced as they pass from the transfer station 5 to the collecting and pressing mechanism 6. The collecting and pressing mechanism 6 includes pressing bands, by which the glue seams are maintained under pressure during the conveying, until the adhesive is securely set.

The transfer station 5 preferably includes at least two pairs of straps 8, 9 and 10, 11, extending substantially parallel to and spaced from each other in the conveying direction, so as to define the conveying elements for the folding boxes. The conveying elements include lower straps 8, 10 and upper straps 9, 11. The folded boxes 7 are conveyed one after another at a distance between the lower straps 8, 10 and the upper straps 9, 11, with the upper straps 9, 11 holding down the folded side flaps 7.1, 7.2 during transport.

The pairs of conveying straps 8, 9 and 10, 11 can be moved and positioned transversely so as to adjust to different widths of blanks. For this, each of the upper conveying straps 9, 11 runs around deflection rollers, which are fastened to a roller rail 21, being suspended in the machine frame such that they can be moved and positioned transversely. Accordingly, each of the lower conveying straps 8, 10 is mounted on a roller cheek, which can be displaced transversely in accordance with the corresponding roller rail 12.

In the transfer station, an extraction mechanism in provided which includes a mechanism for sideways extraction of defective boxes 7 that is arranged on the outside next to the pair of conveying straps 8, 9. The mechanism for extracting the boxes 7 is preferably a turning plate ejector or a linear ejector, similar to those described in the Background of the Invention of the present application. The ejector grabs the boxes 7 at a portion of the box projecting above the conveying straps 8, 9 on the outside and pulls it out from the machine in the direction of arrow 12.

Figure 2:
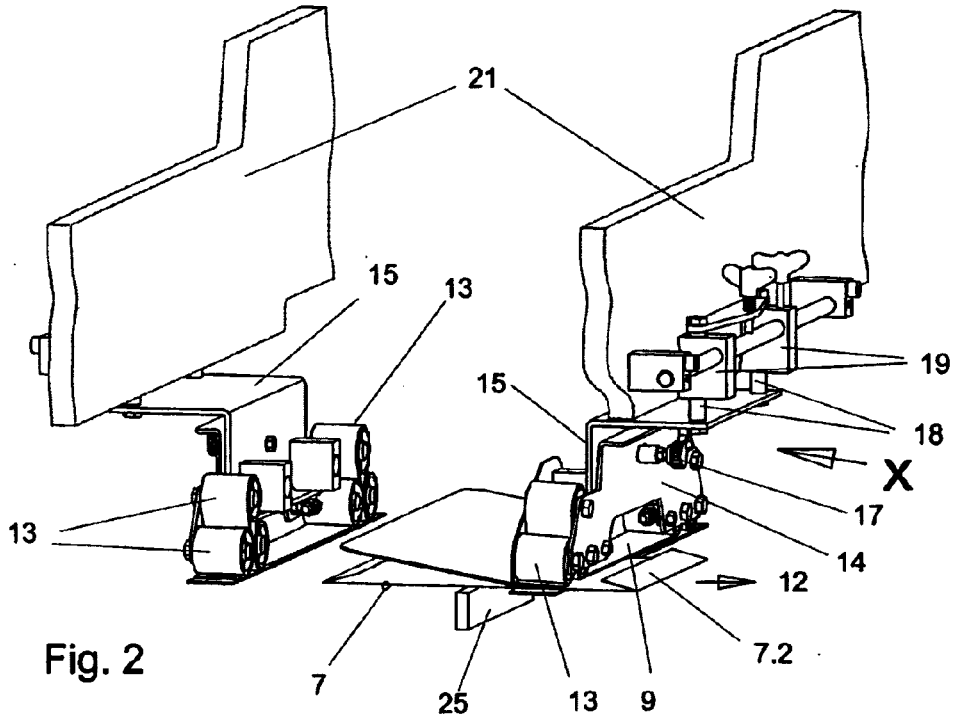
FIG. 2 shows a perspective view of the elements in the transfer station that enable extraction of boxes.
Figure 3:
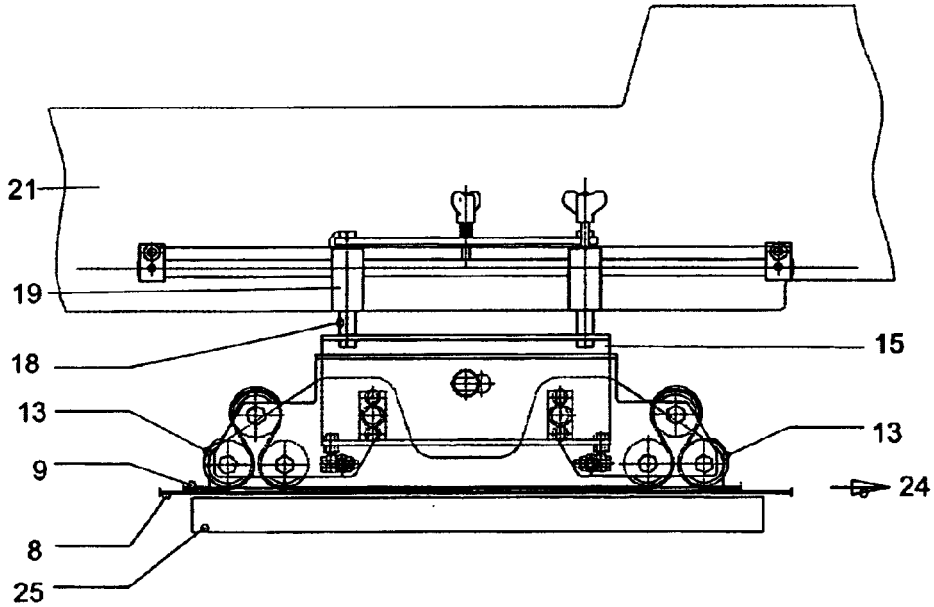
FIG. 3 shows a side view in direction X from FIG. 2.
Figure 4:
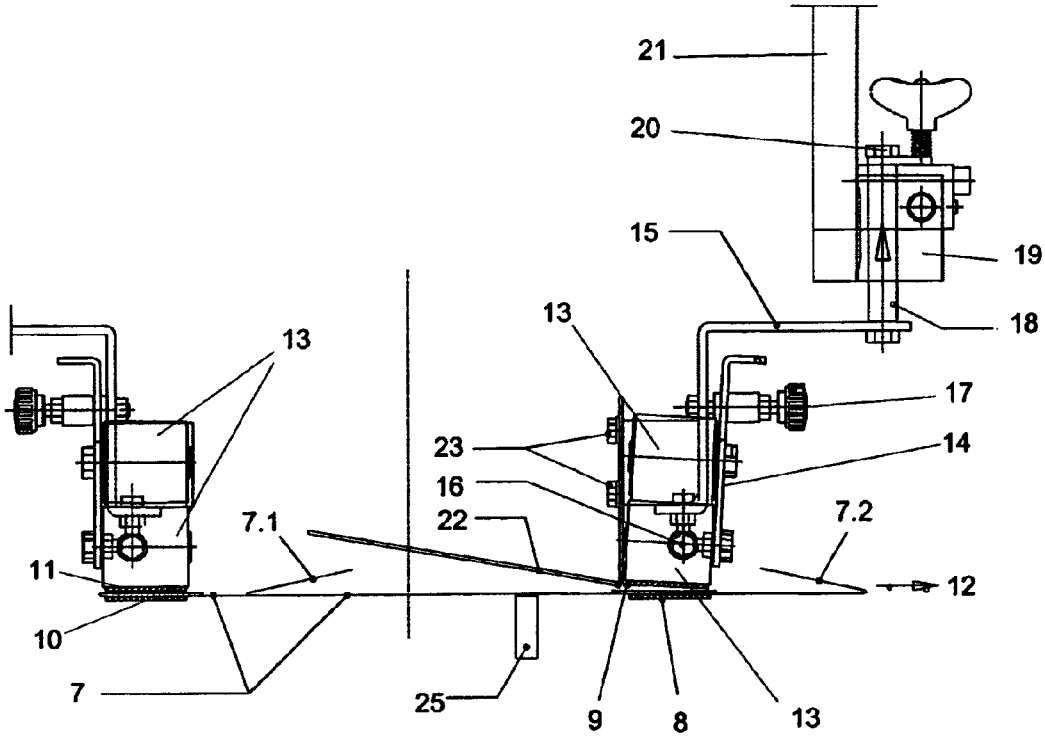
FIG. 4 shows a cross section through the elements of FIG. 2.

In order to provide problem-free extraction of the boxes 7 that have portions with a tendency to open at the side opposite the ejector, the transfer station 5 includes an additional mechanism as shown in FIGS. 2 through 5, on at least one lengthwise side. Preferably, the transfer station 5 includes one such additional mechanism for both pairs of conveying straps 8, 9 and 10, 11 on each lengthwise side, such that boxes 7 can be extracted toward both sides. The additional mechanism for the right pair of conveying straps 8, 9 will now be described in greater detail. The second additional mechanism is illustrated in FIGS. 2 and 4. This second additional mechanism includes the same elements, arranged in mirror symmetry.

Figure 5:
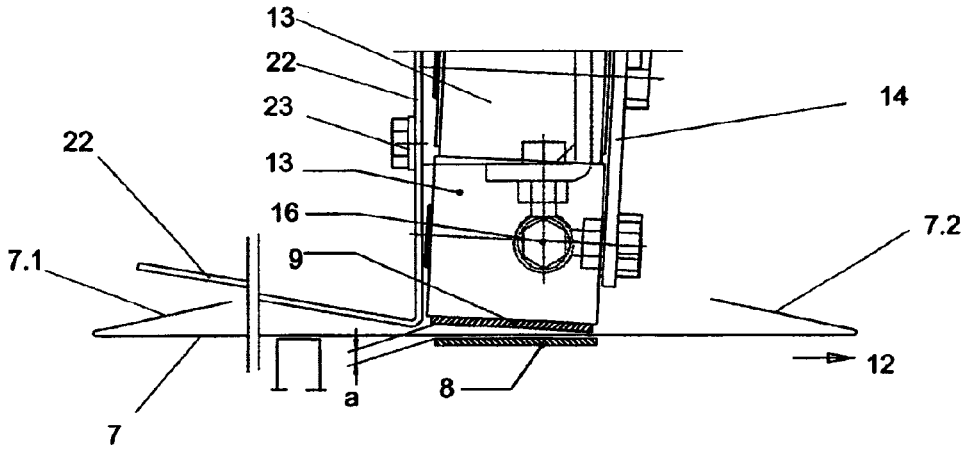
FIG. 5 shows an enlarged segment from FIG. 4.

The upper conveying strap 9 is supported by support rollers 13 along a region of its delivery course. The support rollers 13 are fastened to a bearing plate 14. The bearing plate 14 is arranged such that its lower edge is tilted and inclined inward relative to a perpendicular plane, as shown in FIG. 4 and 5. The bearing plate 14 is hinged to the vertical portion of an angled base plate 15 and can tilt around pivot points 16. The angle of tilt relative to the perpendicular plane is adjusted and set by an adjustment screw 17. Due to the adjusted tilt angle, a corresponding inwardly open entry opening is produced between the lower conveying strap 8 and the upper conveying strap 9, which is supported by the support rollers 13. The width a of the entry opening between the conveying straps 8, 9 is preferably about a few millimeters; in the example, it is preferably about 2 mm. The width of the entry opening is selected to be large enough such that boxes 7 being extracted can be pulled between the two conveying straps 8, 9, and is preferably small enough so as not to deteriorate secure transport of boxes not being extracted.

The horizontal portion of the base plate 15 is fastened to two vertical guide rods 18, which are suspended in a bearing block 19 such that the guide rods 18 can be moved vertically. The extent to which the guide rods 18 and, thus, the parts fastened to the guide rods 18 can move vertically downward is limited by stops 20, which prevent the conveying strap 9 from contacting the conveying strap 8. The horizontal portion of the base plate 15 limits the extent to which the guide rods 18 can move vertically upward. The bearing block 19 is fastened to the roller rail 21, and is thus supported along with roller rail 21 during a transverse positioning.

Preferably, the support rollers 13 are arranged in two groups that are spaced apart from each other, each of the two groups of support rollers 13 is arranged in a triangular shape, and the conveying strap 9 is guided around the support rollers 13 with large contact angles, as shown in FIG. 3. Thanks to the partial guidance behind the bearing plate 14, the strap 9 is prevented from being displaced sideways by the boxes 7 when being pulled out. For further improvement in the guidance of the strap 9 on the support rollers 13, the support rollers 13 are preferably spherical.

On the vertical portion of the base plate 15, a guide baffle 22 is fastened on the inside adjacent to the support rollers 13, being angled upward and inward from the inner edge of the upper conveying strap 9, so as to extend in the direction of the second pair of conveying straps 10, 11. Preferably, the guide baffle 22 extends very close to the pair of conveying straps 10, 11, such that even the front edges of folding flaps 7.1 come into contact with guide baffle 22 on top when being pulled out between the conveying straps 10, 11, and are thus, held down by thereby. Preferably, the guide baffle 22 is vertically adjustably attached to the base plate 15 preferably by screws 23, so that the guide baffle 22 can be adjusted such that no abutting edge is formed relative to the tilted conveying strap 9. On the inside, with slight spacing next to the lower conveying strap 8, a guide rod 25 is arranged horizontally in the conveying direction (arrow 24 in FIG. 3) and substantially parallel to the conveying strap 8, such that the upper edge of the guide rod 25 extends to approximately the height of the lower conveying strap 8. The guide rod 25 prevents the boxes 7 from slipping down when being pulled out.

If a defective box 7 is detected, the defective box 7 is grabbed by the ejector at its projecting edge (in the example, at folding flap 7.2) and pulled out (in the example, to the right) very quickly. The left flap 7.1, springing open as the box is pulled out from the pair of conveying straps 10, 11, moves against the guide baffle 22, which folds it down again as the extraction continues. The tension in the fold increasingly lifts up all parts rigidly connected to the guide baffle 22 during extraction. This is made possible because the base plate 15 is vertically movable in the bearing block 19. Due to the lifting, the box 7 can be pulled through to the outside between the conveying straps 8, 9. The base plate 15 having all parts fastened thereto then drops by its own weight and the strap tension. The following boxes 7, not being extracted, are transported further without disturbance.

If one would like to extract boxes 7 at the other lengthwise side of the transfer station 5, other than moving the ejector, it is only necessary to mount the guide baffle 22 and the guide rod 25 in their position on the other side. This is not even necessary when the two elements 22, 25 are on both lengthwise sides of the transfer station 5. The two guide baffles 22 are then arranged so as to be staggered with respect to each other in the direction of travel 24.

While the present invention has been described with respect to preferred embodiments thereof, it will be apparent to those skilled in the art that the disclosed invention may be modified in numerous ways and may assume many embodiments other than those specifically set out and described above. Accordingly, it is intended by the appended claims to cover all modifications of the invention which fall within the true spirit and scope of the invention.

What is claimed is:

1. A folding box gluing machine for producing folded boxes from blanks, the folding box gluing machine comprising:

a folding station, in which portions of the blanks provided with a glue strip are folded; and a transfer station including a conveyor mechanism, at least two pairs of conveying straps disposed adjacent to the conveyor mechanism, each of the at least two pairs of conveying straps including an upper strap and a lower strap, an adjustable base plate, and a defective box removal device arranged to remove in a sideways direction defective boxes made of the blanks and being located on an exterior portion next to one of the at least two pairs of conveying straps; wherein the upper conveying strap on at least one lengthwise side in the transfer station is supported in a region of its conveying path by support rollers, the support rollers are secured to a bearing plate, said bearing plate being pivotally mounted on the base plate such that a lower edge of the bearing plate is tilted inward with respect to a perpendicular plane producing a v-shaped opening between the upper and lower straps, the bearing plate is arranged so as to move upward to a limited extent; and a guide baffle is secured on an interior portion next to the support rollers, extends upward from an inner edge of the upper conveying strap, and is angled in the direction of the other pair of conveying straps.

2. The folding box gluing machine according to claim 1, wherein the angle of tilt of the bearing plate is adjustable.

3. The folding box gluing machine according to claim 2, wherein the bearing plate tilts around a pivot point, and the angle of tilt relative to the perpendicular plane is adjusted and set by an adjustment screw disposed in the bearing plate.

4. The folding box gluing machine according to claim 1, wherein the upper conveying strap is supported by two groups of said support rollers arranged at a distance from each other.

5. The folding box gluing machine according to claim 4, wherein each of the two groups of support rollers is arranged to define a triangular configuration.

6. The folding box gluing machine according to claim 1, wherein the support rollers are spherical.

7. The folding box gluing machine according to claim 1, wherein the guide baffle is secured to a suspension of the bearing plate so as to be vertically adjustable.

8. The folding box gluing machine according to claim 1, wherein a support rod is arranged on the interior portion next to and substantially parallel to the lower conveying strap such that an upper edge of the support rod is located approximately at the height of the lower conveying strap.

9. The folding box gluing machine according to claim 1, wherein the upper conveying strap on the other lengthwise side in the transfer station is supported in a region of its conveying path by additional support rollers, the additional support rollers are secured to an additional bearing plate that is mounted such that a lower edge of the additional bearing plate is tilted inward with respect to the perpendicular plane, the additional bearing plate is arranged so as to move upward to a limited extent.

10. The folding box gluing machine according to claim 1, wherein the a base plate having a vertical portion and a horizontal portion, the bearing plate being hinged to the vertical portion of the base plate, the horizontal portion of the base plate is fastened to two vertical guide rods which are suspended in a bearing block such that the guide rods are movable in a vertical direction so as to enable the bearing plate to move upward to a limited extent.

11. A transfer station for use in a folding box gluing machine comprising:

a conveyor mechanism;

at least two pairs of conveying straps disposed adjacent to the conveyor mechanism, each of the at least two pairs of conveying straps including an upper strap and a lower strap, an adjustable base plate; and a defective box removal device arranged to remove in a sideways direction defective boxes made of the blanks and being located on an exterior portion next to one of the at least two pairs of conveying straps; wherein the upper conveying strap on at least one lengthwise side in the transfer station is supported in a region of its conveying path by support rollers, the support rollers are secured to a bearing plate, said bearing plate being pivotally mounted on the base plate such that a lower edge of the bearing plate is tilted inward with respect to a perpendicular plane producing a v-shaped opening between the upper and lower straps, the bearing plate is arranged so as to move upward to a limited extent; and a guide baffle is secured on an interior portion next to the support rollers, extends upward from an inner edge of the upper conveying strap, and is angled in the direction of the other pair of conveying straps.

12. The transfer station according to claim 11, wherein the angle of tilt of the bearing plate is adjustable.

13. The transfer station according to claim 12, wherein the bearing plate tilts around a pivot point, and the angle of tilt relative to the perpendicular plane is adjusted and set by an adjustment screw disposed in the bearing plate.

14. The transfer station according to claim 11, wherein the upper conveying strap is supported by two groups of said support rollers arranged at a distance from each other.

15. The transfer station according to claim 14, wherein each of the two groups of support rollers is arranged to define a triangular configuration.

16. The transfer station according to claim 11, wherein the support rollers are spherical.

17. The transfer station according to claim 11, wherein the guide baffle is secured to a suspension of the bearing plate so as to be vertically adjustable.

18. The transfer station according to claim 11, wherein a support rod is arranged on the interior next to and substantially parallel to the lower conveying strap such that an upper edge of the support rod is located approximately at the height of the lower conveying strap.

19. The transfer station according to claim 11, wherein the upper conveying strap on the other lengthwise side in the transfer station is supported in a region of its conveying path by additional support rollers, the additional support rollers are secured to an additional bearing plate that is mounted such that a lower edge of the additional bearing plate is tilted inward with respect to the perpendicular plane, the additional bearing plate is arranged so as to move upward to a limited extent.

20. The transfer station according to claim 11, wherein the a base plate having a vertical portion and a horizontal portion, the bearing plate being hinged to the vertical portion of the base plate, the horizontal portion of the base plate is fastened to two vertical guide rods which are suspended in a bearing block such that the guide rods are movable in a vertical direction so as to enable the bearing plate to move upward to a limited extent.

* * * * *